United States Patent [19]

Oko et al.

[11] Patent Number: 4,576,708

[45] Date of Patent: Mar. 18, 1986

[54] BENEFICIATION OF SHALE KEROGEN AND ITS CONVERSION INTO SHALE OIL

[75] Inventors: Uriel M. Oko, Tulsa, Okla.; Robert M. Baldwin, Golden, Colo.

[73] Assignee: Cities Service Oil & Gas Corp., Tulsa, Okla.

[21] Appl. No.: 638,123

[22] Filed: Aug. 6, 1984

[51] Int. Cl.[4] ..... C10G 1/04

[52] U.S. Cl. ..... 208/11 LE

[58] Field of Search ..... 208/11 LE, 8 LE

[56] References Cited

U.S. PATENT DOCUMENTS

| | | | |
|---|---|---|---|
| 3,291,117 | 12/1966 | White | 208/11 LE |
| 3,808,120 | 4/1974 | Smith | 208/11 LE |
| 4,221,653 | 9/1980 | Chervenak et al. | 208/11 LE |
| 4,385,982 | 5/1983 | Anderson | 208/11 LE |
| 4,425,227 | 1/1984 | Smith | 208/11 LE |

FOREIGN PATENT DOCUMENTS

| | | | |
|---|---|---|---|
| 491955 | 4/1953 | Canada | 208/11 LE |
| 792222 | 8/1968 | Canada | 208/11 LE |

OTHER PUBLICATIONS

Perry, "Chemical Engineers' Handbook", 5th ed., pp. 21-65 to 21-67 (1973).

Considine (Managing Editor), Von Nostrand's Scientific Encyclopedia (6th Ed) under "Tar Sand".

*Primary Examiner*—John Doll

*Assistant Examiner*—A. Pal

*Attorney, Agent, or Firm*—John Wade Carpenter

[57] ABSTRACT

A process for the production and the conversion of shale kerogen to produce shale oil. The process includes grinding crushed shale into a first product and treating the first product with a first collector. The treated first product is introduced into a first flotation zone in order to recover liberated kerogen. Subsequently, the recovered liberated kerogen is ground into a second product which is treated with a second collector. The treated second product is introduced into a second flotation zone in order to recover clean kerogen. The recovered clean kerogen is mixed with a liquid means to form a pumpable kerogen paste which is subsequently introduced into a reaction zone in order to convert the kerogen in the pumpable kerogen paste into a hydrocarbon liquid that is subsequently removed from the reaction zone.

108 Claims, 1 Drawing Figure

BENEFICIATION OF SHALE KEROGEN AND ITS CONVERSION INTO SHALE OIL

BACKGROUND OF THE INVENTION

1. Field of the Invention

This invention is related to the recovery of shale oil. More specifically, this invention provides a process for recovering kerogen from oil shale and converting the kerogen into shale oil. The utility of this invention lies in the process of recovering a superior quality shale oil from oil shale and the disposal of nontoxic shale rock tailings.

2. Description of the Prior Art

Kerogen is a bituminous substance present in the matrix of oil shale. The recovery of kerogen from the oil shale, and the subsequent refining of the kerogen to give shale oil, is well known in the art. Typical prior art processes for obtaining shale oil from oil shale concern mining and crushing of the oil shale, retorting of the crushed shale, and recovery of shale oil from the retort. Conventional retorting processes result in the production of a large volume of hot, partially clinkered residual shale containing varying amounts of sintered carbonaceous material, and gaseous by-products from the retort, typically containing compounds of hydrogen, hydrocarbons, carbon as coke, nitrogen, and sulfur. All of these products are environmentally undesirable. A certain percentage of the hydrocarbon values in the shale oil are consumed in the retorting process as fuel to provide the temperature needed in the retort. Also, it is well known that in the process of retorting, free oxygen from the air used to generate retort heat dissolves in the shale oil product, thereby lowering its quality. The maintenance costs involved in the crushing and retorting of the rock in retort processes increase the cost of recovery of the resultant shale oil. Furthermore, because the retort is not pressurized, the gaseous products are lost. The coke is also lost with the sintered tailings. All of these losses may amount to about fifty percent (50%) of the organic kerogen originally in the shale.

U.S. Pat. No. 3,726,784 by Correa et al. relates to the hydrotreating of a liquid product produced by liquefying coal; and more particularly, to processes wherein the liquefaction zone, in which coal is liquefied, and the hydrotreating zone, in which liquefied coal is hydrotreated, are both operated at essentially equivalent pressures. U.S. Pat. No. 4,018,663 by Karr provides a coal liquefaction process for converting coal to crude petroleum refinable by conventional petroleum refining techniques to produce gasoline and/or diesel fuel. U.S. Pat. No. 4,083,769 by Hildebrand et al. teaches a process for converting ash-containing raw coal to deashed coal liquids in preference to deashed coal solids. U.S. Pat. No. 4,190,518 by Giannetti et al. discloses a process for producing from coal an upgraded solid material which is solid and/or semi-solid at room temperature and which is capable of later being combined with a liquid for further uses. U.S. Pat. No. 4,255,248 by Rosenthal et al. provides a process wherein subdivided coal is dissolved in a process-derived solvent having a low heptane insoluble content and is subsequently hydrocracked under specified process conditions. U.S. Pat. No. 4,410,415 by Seitzer discloses a method for lowering the pourpoint of a shale oil obtained by retorting oil shale. The method involves contacting the shale oil with fresh, unretorted oil shale, preferably at elevated temperatures. U.S. Pat. No. 4,348,274 by Guerre relates to a process for the upgrading or beneficiation of oil shale and is particularly concerned with upgrading raw oil shale by physically removing a substantial portion of the lower grade shale particles through the use of gravimetric separations. U.S. Pat. No. 4,075,081 by Gregoli teaches a process for extracting oily constituents from oil shale by eliminating the retorting stage of conventional shale upgrading.

What is needed and what has been invented by me is a process for the production of kerogen from shale oil which does not include the deficiencies of conventional processes and which is not taught or suggested by the prior art.

SUMMARY OF THE INVENTION

It is therefore an object of this invention to provide an economical process for reducing the amounts of environmentally undesirable products emitted in the recovery of shale oil from the kerogen that is found in oil shale.

It is another object of this invention to provide an economical process for reducing the cost of obtaining shale oil from oil shale by various means, such as reducing the cost of grinding.

It is another object of this invention to produce quality oil from shale. The quality of the oil is substantially higher than the oil produced in a conventional retort.

It is yet another object of this invention to provide an economical process for recovering shale oil from the kerogen found in oil shale that does not produce coke or calcine and utilizes a smaller sized retort for a given input of oil shale.

Still other objects will be apparent to those skilled in the art from the following description of this invention.

The foregoing objects are achieved according to the practice of this invention. Broadly, this invention comprises a process for the production and conversion of shale kerogen to produce shale oil. The process includes grinding crushed shale into a first product consisting essentially of an inert matter and liberated kerogen having an average fineness of between about 5 microns to about 250 microns. The surface of the first product including the ground-liberated kerogen is treated with a first collector in order to render the ground-liberated kerogen air-avid and water-repellent. The ground-treated first product is introduced into a first water suspension medium having a first frother. The process additionally comprises aerating and agitating the first water suspension medium having the first frother in order to form a layer of foam on top of the first water suspension medium such that air-avid treated liberated kerogen having an average fineness of between about 5 microns to about 250 microns attaches to the rising bubbles of aeration where it collects in the foam, and skimming off the collected liberated kerogen from the surface of the first water suspension medium in order to recover liberated kerogen having an average fineness of between about 5 microns to about 250 microns. The recovered liberated kerogen is subsequently ground into a second product consisting of essentially generally disassociated inert matter and generally clean kerogen having an average fineness of between about 0.5 microns to about 45 microns. The surface of the second product including the ground-clean kerogen is treated with a second collector in order to render the ground-clean kerogen air-avid and water-repellent. The ground-treated second product is introduced into a second water suspension medium having a second frother. The second water suspension medium having the second frother is aerated in order to form a second layer of foam on top of the second water suspension medium such that air-avid treated clean kerogen having an average fineness of between about 0.5 to 45 microns attaches to the rising bubbles of aeration where it collects in the foam. The collected clean kerogen product is skimmed off the surface of the second water suspension medium in order to recover a clean kerogen product having an average fineness of between about 0.5 to 45 microns. The recovered clean kerogen product is mixed with a liquid means to form a pumpable kerogen paste which is subsequently introduced into at least one reaction zone maintained at a pressure of between about 50 to 5,000 psi. and a temperature of between about 300 degrees Fahrenheit and 1,000 degrees Fahrenheit in order to convert the kerogen in the pumpable kerogen paste into a hydrocarbon liquid that is subsequently removed from the reaction zone. These reactor temperatures are well below the temperature at which the non-kerogen minerals of the host rocks will calcine.

Thus, by the practice of this invention there is provided an economical process for reducing the amounts of environmentally undesirable products associated in the process for the production and conversion of shale kerogen to produce shale oil. The practice of this invention also reduces the costs of obtaining shale oil from oil shale by various means, such as reducing the costs of grinding including maintenance, removing and recovering some of the gaseous products containing nitrogen and sulfur, and reducing the costs of retorting by using a smaller sized reactor which handles beneficiated kerogen rather than raw shale. The reactor of this invention is pressurized; hence, the gaseous products can be scrubbed off economically for sale. The reactor of this invention is also at a relatively low temperature which retards and substantially prevents the formation of coke. Fischer Assay of values of product are about 30 to 50% by weight more than Fischer Assay retorted raw shale because of the prevention of the formation of coke in the reactor, whose maximum temperature is well below that of conventional retorts. Moreover, by the practice of this invention, a superior shale oil product is being recovered which contains substantially lower concentrations of deleterious nitrogen, sulfur, oxygen and arsenic concentrations.

BRIEF DESCRIPTION OF THE DRAWING

The drawing is a schematic flow diagram of an embodiment for the process for production and solvent refining of beneficiated shale kerogen.

DETAILED DESCRIPTION OF THE INVENTION

Figure 1:
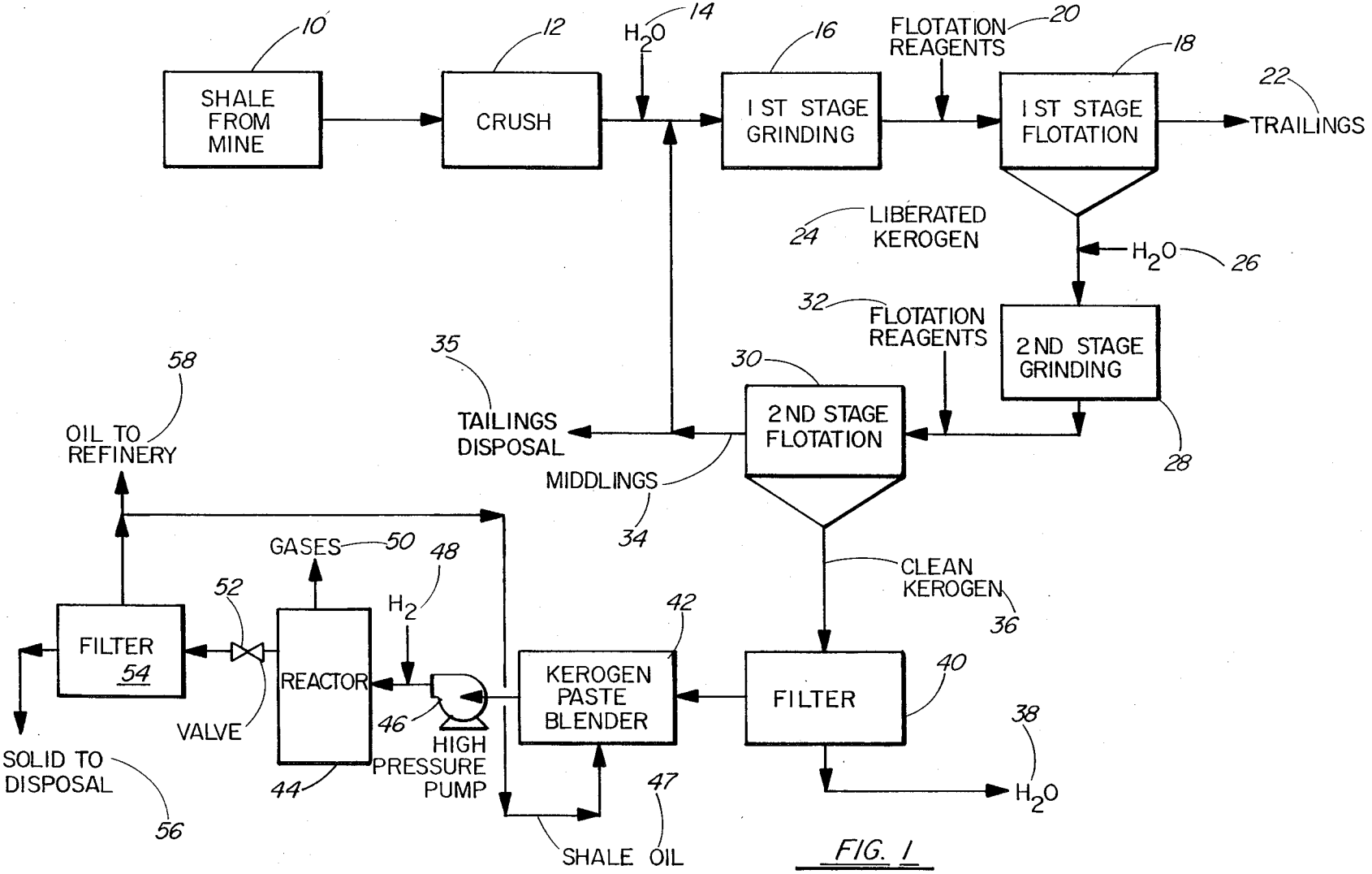

Referring in detail now to the drawing, oil shale, generally illustrated as 10, consists of an organic fraction, kerogen, in intimate contact with inorganic minerals which consist largely of dolomite, calcite, and aluminosilicate clays. The mining of oil shale 10 in order to remove kerogen is well known in the art. When used in prior art above-ground retorting, the size of mined oil shale 10 varies from about ¼ inch to about 8 inches or larger. Mined oil shale 10 of this size is generally satisfactory as feed for a crushing stage 12 of the present invention.

Crushing stage 12 may be any suitably known crushing means utilized to reduce the size of the mined oil shale 10 to a crushed product varying from about ¼ inch to about ½ inch. The crushed shale product from the crushing stage 12 is subsequently mixed with water 14 such that between about 10 to about 50% by weight of the mixture is a crushed shale product, and the aqueous crushed shale product slurry is sent to a first-stage grinder 16. The water medium in which the crushed shale product is dispersed acts as a grinding aid and enables more efficient use of energy.

In a preferred embodiment of the invention, the aqueous crushed shale product is ground into a first-stage product having an average fineness of between about 5 microns and 250 microns, preferably between 120 and 180 microns, and consisting essentially of generally inert matter, liberated kerogen, and kerogen associated with the inert matter. Subsequent to grinding, the first-stage product is then processed for a first flotation stage 18. The first-stage product is treated with flotation reagents 20, such as a promoter and/or a collector, in order to provide the liberated kerogen particles with a water-repellent, air-avid coating that will adhere to an air bubble. Preferably, treatment with flotation reagents 20 is in a conditioning tank (not shown in the drawing). The flotation reagent 20 is fed continuously to the conditioner, sufficient time being allowed to cause complete "filming" of the liberated kerogen particles by the flotation reagent 20. Any conditioning tank and method for conditioning may be used in the invention, such as those disclosed in "Unit Operations" by George G. Brown, John Wiley & Sons Publishers (1951); in the "Chemical Engineers' Handbook" (Fifth Edition) by Perry and Chilton, McGraw Hill Book Co. Publishers; or in "Mineral Processing" by J. E. Prior, Elsevier Publishing Co., N.Y. (1965). It should be understood that, instead of using a conditioner tank, the flotation reagents 20 may treat the liberated kerogen particles directly prior to processing into the first flotation stage 18 or, alternatively, the liberated kerogen particles may be treated with the flotation reagents 20 directly in the first flotation stage 18 itself.

After the inert matter, liberated kerogen, and kerogen associated with the inert matter, all of the first-stage product, have been thoroughly treated with the flotation reagent 20, they are introduced into a first water medium having a frother where they are suspended by a means for agitation. When the first water medium is aerated in the presence of the frother while simultaneously being agitated, a layer of froth or foam forms on top of the first water medium. The air-avid treated liberated kerogen, some kerogen still associated with inert matter, and some inert matter, all having an average fineness of between about 5 microns to 250 microns, attach to the rising bubbles of aeration where they collect in the froth. The treated inert matter, on the other hand, is usually depressed or generally rendered nonfloatable because its surface is essentially left unaltered by collector adsorption. More than fifty percent (50%) of the treated inert matter remains in the first water medium along with some minor residual kerogen associated with it, and is removed as tailings 22 which constitutes about 50 to about 75% by weight of the original shale rock 10.

In some cases it may be necessary to render the inert matter nonfloatable through the use of modifying agents such as depressants (e.g., ligno sulfates, starch, gelatin, saponin, sodium metaphosphate, sodium silicate, dextrin, aluminum hydroxide, iron hydroxide, lime and quebracho, and mixtures thereof) or activators (e.g., sulfuric acid, sodium hydroxide, calcium hydroxide, and mixtures thereof) applied to the first-stage product at a temperature between about 0 degrees centigrade and 50 degrees centigrade and in quantities such as to film or cover the surfaces of the first-stage product with a film at a ratio varying from about 0.05 to about 10.0 lbs. of the modifying agent per ton of the first-stage product. The modifying agents are usually applied in a conditioning tank (not shown on the drawing) before the flotation reagents 20 and in a manner similar to the flotation reagents 20. A conditioning tank is not absolutely necessary and the modifying agents may be applied directly to the first-stage product (before the flotation reagents 20) prior to processing into the first flotation stage 18, or alternatively, the first stage product may be treated with the modifying agents (before the flotation reagents 20) directly in the first flotation stage 18 itself. The modifying agents may be used to activate or to depress the adsorption of the collector by reacting with the surface of the inert matter, either by chemical action or by adsorption, to change the character of the surface of the inert matter, thereby preventing the adsorption of the collector on the inert matter.

The liberated kerogen with an average fineness of between about 5 microns to about 250 microns, along with some inert matter still in association therewith, is recovered as liberated kerogen concentrate 24 when the froth or foam is skimmed off. The concentrate 24 comprises enriched liberated kerogen plus some shale matrix. Typically, between about 50 to about 95% by weight of the original kerogen is found in this concentrate 24, and the pure kerogen concentration has been improved from 25 gal./ton in the raw shale 10 to between about 40 gal./ton, to about 60 gal./ton in the concentrate 24 as estimated by the Fischer Assay.

The recovered liberated kerogen concentrate 24 having an average fineness of between about 5 microns to about 250 microns may be admixed with a water 26, depending on the water or moisture content of the liberated kerogen concentrate 24, such that between about 10 to about 50% by weight of the mixture is the recovered liberated kerogen concentrate 24, and the aqueous liberated kerogen slurry is sent to a second-stage grinder 28. As in the first-stage grinder 16, the water medium in which the kerogen concentrate 24 is dispersed acts as a grinding aid and enables more efficient use of energy.

The grinding in the second-stage grinder 28 takes much less energy than in the first-stage grinder 16 because only a fraction of the original shale rock 10 is treated and because the recovered liberated kerogen concentrate 24 is relatively soft, requiring less energy for grinding. The energy to grind kerogen concentrate 24 is considerably less than that for grinding the host shale rock 10 in the first-stage grinder 16 after being crushed by crusher 12.

The aqueous-recovered liberated kerogen concentrate product 24 is ground by grinder 28 into a second-stage product consisting essentially of generally disassociated inert matter and clean kerogen having an average fineness of between about 0.5 microns to about 45 microns, preferably 20 microns. The second-stage product is subsequently processed for a second flotation stage 30. The second-stage product is treated with flotation reagents 32 (such as the promoter or collector that was used to treat the first stage product) in a conditioning tank (not shown in the drawing) in order to provide the clean kerogen particles with a water repellent, air-avid coating that will adhere to an air bubble. As was seen for the case of flotation reagents 20, a conditioning tank is not necessary and the flotation reagents 32 may treat the second-stage product directly prior to processing into the second flotation stage 30 or, alternatively, the second-stage product may be treated with the flotation reagents 32 directly in the second flotation stage 30 itself. The flotation reagent 32 "films" the clean kerogen particles in the conditioner just as the flotation reagent 20 "filmed" the liberated kerogen particles. However, this filming is more in the form of a reinforcing of an existing residual film that is a carry-over from the filming or coating with flotation reagent 20.

After the disassociated inert matter and clean kerogen of the second-stage product have been thoroughly treated with the flotation reagent 32, they are introduced into a second water medium having a frother. The second-stage product does not have to be suspended by means for agitation in the second water medium as was necessary for the first-stage product in the first water medium. When the second water medium, as was the case for the first water medium, is aerated in the presence of the frother, a layer of froth or foam forms on the top of the second water medium. The air-avid treated clean kerogen product, having an average of between about 0.5 to 45 microns, attaches to the rising bubbles of aeration where it collects in the froth or foam. The treated disassociated inert matter remains in the second water medium and is removed from it as middlings 34 which can be disposed of to tailings disposal 35 or, preferably, recycled to the first-stage grinder 16 for reprocessing to recover any residual liberated kerogen particles.

The treated disassociated inert matter, as was the case for the treated inert matter in the first flotation stage 18, is usually rendered nonfloatable because its surface is essentially left unaltered by collector adsorption. However, as also was the case for the inert matter of the first flotation stage 18, it may be necessary to render the disassociated inert matter nonfloatable through the use of modifying agents, such as one of the previously mentioned depressants or activators that may have been used in the first-step product. The modifying agent is applied to the second-stage product before the flotation reagents 32 at a temperature between about 0 degrees centigrade and 50 degrees centigrade and in quantities such as to film the surfaces of the second-stage product at a ratio varying from about 0.05 to about 10.0 lbs. of the modifying agent per ton of the second stage product. The modifying agents for the second flotation stage 30 changes the character of the surface of the disassociated inert matter, and are applied in a conditioning tank (not shown in the drawing) in a manner similar to how the flotation reagents 32 and 20 were applied. As was previously mentioned for the modifying agent being applied to the first-stage product, it is not necessary to use a conditioning tank. The modifying agents for the second flotation stage 30 may be applied directly to the second-stage product (before the flotation reagents 32) prior to processing into the second flotation stage 30 or, alternatively, the second-stage product may be treated with the modifying agents (before the flotation reagents 32) directly in the second flotation stage 30 itself.

The clean kerogen with an average fineness of between about 0.5 to 45 microns is recovered as clean kerogen concentrate 36 when the froth or foam is skimmed off, and preferably includes at least 40% by weight of pure kerogen. Preferably, although not necessary, the clean kerogen concentrate 36 is separated or dried from any water 38, such as by filtration with filter 40, before being further processed. The filtered clean kerogen concentrate may still contain from between about 0.5 to about 60% by weight of water. The water 38 recovered by filtering may be utilized in any of the two grinding stages 16 and 28, or as any of the two water suspension medium for the treated products in the two flotation stages 18 and 30. When the clean kerogen concentrate 36 is dried, it has the appearance of talcum powder and is the result of about 50 to 95% by weight recovery of the kerogen in the mined oil shale 10. This concentrated clean kerogen grade contains about four (4) times the concentrate of oil per unit weight as assayed in the original shale 10 on the Fischer Assay. For example, 100 gal./ton of oil in the clean kerogen concentrate 36 has been upgraded from 25 gal./ton of oil in the original shale oil as assayed by Fischer Assay.

I have discovered, as was previously mentioned, that suspension of the second-stage product in the second water medium is generally not necessary and that merely aerating the second water medium gives a relatively mild agitation and produces a clean froth or foam on top of the second water medium, relatively free from gangue. Because of the more violent agitation that can be obtained with mechanical agitators, especially those that agitate the treated ground product in the water medium and simultaneously draw in air and beat it into the suspended treated ground product, an agitator is preferably only utilized in the first flotation stage 18 in conjunction with aeration to give more thorough flotation and separation of the inert matter tailings 22. It is preferably not utilized in the second flotation stage 30 in conjunction with aeration in separating out disassociated inert matter middlings 34 from the clean kerogen concentrate 36 because severe agitation will cause impurities to float and be removed with the clean kerogen concentrate 36. It should be understood, however, that, depending on the amount and types of impurities contained within the treated second product and the coarseness or size of the treated second product, it may be desirable and/or necessary to suspend or partially suspend in the second water medium by agitating for a predetermined period of time the treated second product prior to aerating in order to facilitate the treated clean kerogen attaching to the air bubbles. The predetermined period of time may be a shorter agitation time (e.g., ½ minute) than the agitation time for the first flotation stage 18 in order to keep the impurities suppressed.

Aeration time for the first and the second water medium may be any suitable time necessary to accomplish the purpose of aeration. I have discovered that, preferably, the aeration time should be from about ½ minute to about 2 hours; more preferably, from between about 5 and 20 minutes; and most preferably, the aeration time is generally about 10 minutes. Likewise, the agitation time for suspension of the treated first product or the treated second product, if desirable and/or necessary, in the first and second water medium, respectively, may be any suitable time necessary to accomplish the purpose of agitation. I have discovered that the agitation time should preferably be from about 15 seconds to about 2 hours; more preferably, from between about 4 and 22 minutes; and most preferably, from between about 8 and 12 minutes. The agitation time, as was previously noted, may be different in the second flotation stage 30 than in the first flotation stage 18. The times for aeration and agitation may depend on the rates of aeration and agitation, respectively.

In a preferred embodiment of the invention any means for aeration and/or means for agitation may be utilized in the first and/or second water medium in order to aerate and/or agitate the same. Preferred aeration means and/or agitation means are those illustrated in the "Chemical Engineers Handbook" (Fifth Edition) by Perry and Chilton, McGraw Hill Book Co. Publishers, or in "Unit Operations" by George G. Brown, John Wiley & Sons Publishers (1951). The aeration rate may be any suitable rate in order to elevate air-avid liberated kerogen particles or air-avid clean kerogen. Perferably, the aeration rate is between about 5 and 15 cubic foot per minute per square foot of tank area that holds the first and/or the second water medium. Likewise, the agitation rate may be any suitable rate of agitation in order to suspend the treated first product or the treated second product if desirable and/or necessary in the first and second water suspension medium, respectively. Preferably, the agitation rate of an impeller speed tip with a flotation machine means is between about 5 and 2,000 ft./min..

More preferably, and by way of example using a Denver cell with a volume of 100 cubic feet, the agitation rate of the impeller speed tip is between about 1,350 and 1,800 ft./min. The preferred density of suspension for the treated first product in the first water medium and, if desirable and/or necessary, the treated second product in the second water medium is at an average pulp density of between about 10 to about 45% solids.

The operating temperature in the two grinding stages 16 and 28 and in the two flotation stages 18 and 30 is between about 0 degrees centigrade and 50 degrees centigrade, preferably between about 0 degrees centigrade and 25 degrees centigrade, in order to compensate for the smearing action of kerogen when oil shale is crushed and/or ground. When kerogen smears on the surfaces of oil shale particles, there develops a tendency for the smeared particle to float like kerogen and, thus, reduce the grade of the kerogen concentrate that is produced.

In a preferred embodiment of the invention, the collector in the first and second flotation stages 18 and 30 is preferably one selected from the group consisting of crude or refined fatty acids from biological sources (e.g., tall oil, lignin, tallow) and their soaps and fatty nonbiological sources, such as petroleum kerosenes, or shale oil fractionation products or their sulfonates (i.e. petroleum sulfonates) and amines, such as methyl octadecyl amine, lauryl-amine hydrochloride, and sodium oleate, oleic acid, linoleic and linolenic acids, and mixtures thereof, and is applied to the products in quantities such as to form a film or a coat on the surface of the product at a ratio varying from between about 0.005 to about 10.0 lbs. of collector per ton of product. More preferably, the collector is applied in quantities of between about 0.2 to about 2 lbs. of collector per ton of product. The preferred collectors are light oil cuts, such as kerosene or diesel oil. The most preferred collectors are 400 to 600 degrees Fahrenheit shale oil cuts that have not been hydrogenated.

The frother in the two flotation stages 18 and 30 may be any suitable frother, such as pine oils or those produced and sold by Dow Chemical Co. under the trademark Dowfroth, but is preferably one selected from the group consisting of methyl amyl alcohol, methylisobutylcarbinol, polypropylene glycol ether, pine oil, cresylic acid, and any other 5 to 8 carbon aliphatic alcohols [(e.g., terpinols ($C_{10}H_{17}OH$) and pentandiol ($HO\ CH_2\ (CH_2)\ _3CH_2OH$)], and mixtures thereof. All of these compounds are infinitely soluble in water and tend not to interfere with depressants and/or collectors, the function of which is to cause kerogen to adhere to the bubbles which the frother promotes. The frother preferably comprises between 0.01 to about 0.50% by weight of the water medium in the two flotation stages 18 and 30 and prevents coalescence of air bubbles when they reach the surface of the two water mediums, thereby maintaining a persistent froth on each medium.

In the instant invention, the acidity or pH of the first and second water medium is an important factor controlling or modifying the ease of frothing. Frothing has been found to be possible within a pH range of 5 to 10. In a preferred embodiment, the pH is about neutral (i.e., 6.5). Therefore, alkalinity regulators such as sulfuric acid, lime, and soda ash may be used to control or adjust the pH of the first and second water suspension medium.

By using two stages of grinding 16 and 28, with the intermediate removal of tailings 22 and middlings 34 through two stages of flotation 18 and 30, grinding and grinder maintenance costs are reduced: vis-a-vis, a single stage of grinding that would result in the same size product. The volume of flotation equipment that is needed is also minimized significantly because most of the tailings are removed after the first stage of flotation.

The recovered clean kerogen concentrate 36 is subsequently mixed in a blender 42 with a liquid means to form a pumpable kerogen paste as feed for at least one reactor 44. Liquid means may be any suitable liquid that is compatible with required temperatures and pressures of the process, such as, but not by way of limitation, water or a hydrocarbon liquid. Preferably the liquid means is a hydrocarbon liquid. The preferred hydrocarbon liquid may be selected from a wide range of choices, such as various cuts from refinery petroleum streams, crude oil, synthetic oil, and atmospheric residues. Preferably, the hydrocarbon liquid is shale oil. More preferably, the hydrocarbon liquid is a recycled stream of +650 degrees Fahrenheit cut of shale oil 47 from a downstream separation of the reactor effluent (e.g., the stream from a hot, low pressure separator not shown in the drawing). Such a recycled hydrocarbon stream forms a pumpable kerogen paste and can furnish an appreciable portion of the heat needed for the proper operation of the reactor 44.

The liquid means (vol.)/clean kerogen solid product (wt.) ratio of the pumpable kerogen paste feed may vary from a barely pumpable mixture to a highly diluted, low-viscous mixture, depending on the nature of the liquid means, the mixing temperature, the operating conditions in the reactor 44, and the desired throughput of the recovered clean kerogen product. In a preferred embodiment of the invention, this ratio preferably may vary from about 5:1 to about 50:1. More preferably, this ratio varies from about 10:1 to about 30:1; most preferably, the ratio is from about 15:1 to about 25:1. For example, a 30:1 liquid means recovered kerogen product ratio means 30 Bbls. of liquid means (preferably recycled hydrocarbon liquid) per ton of recovered kerogen concentrate.

Pumpable kerogen paste is introduced subsequently by a high-pressure pump 46 into the reactor 44 maintained at a pressure of between about 50 to 5,000 psi., and a temperature of between about 300 degrees Fahrenheit and about 1,000 degrees Fahrenheit in order to preferably convert at least 50% by weight of the kerogen in the pumpable kerogen paste into a hydrocarbon liquid, which is preferably shale oil. The kerogen does not have to be dry for this purpose; it may contain some 0.5 to 20% by weight of water.

Since the pumpable kerogen paste is generally not at a sufficient temperature for proper reactor conditions, the pumpable kerogen paste may be preheated prior to introducing into the reactor 44, such as by passing it through a furnace (not shown in the drawing). Alternatively, the liquid means, such as the preferred hydrocarbon liquid or recycled hydrocarbon liquid, may be heated prior to mixing with the recovered clean kerogen concentrate 36. The temperature of the pumpable kerogen paste in proximity to the inlet of the reactor 44 is preferably between about 100 degrees Fahrenheit and about 900 degrees Fahrenheit in order that when the paste enters the reactor 44, which is preferably at a temperature of over 300 degrees Fahrenheit, the inlet temperatures of the pumpable kerogen paste approximate the temperatures of the reactor 44 and the reactor 44 becomes more efficient and uses less energy in the conversion of the kerogen in the pumpable kerogen paste into a hydrocarbon liquid.

I have discovered that the reactor 44 for the present invention may be any type of reactor having any type of flow as long as the pressure is between about 50 and 5,000 psi. and the temperature is above at least 300 degrees Fahrenheit, preferably between about 500 degrees Fahrenheit and about 1,000 degrees Fahrenheit. It is understood that there may be more than one reactor 44 in series or parallel for converting of shale kerogen to produce shale oil.

In a preferred embodiment of the invention, the reactor 44 includes a hydrogenation catalyst which would enable a conversion rate of preferably at least 50% by weight of the kerogen in the pumpable kerogen paste. The type of catalyst employed would depend on the analysis of the non-kerogen portion of the clean kerogen concentrate 36 because crushed, ground oil shale minerals which remain with the clean kerogen can also have catalytic properties. The particular hydrogenation catalyst would depend upon various factors such as cost, availability, and the kerogen conversion level desired.

Such hydrogenation catalysts may be selected from the groups consisting of cobalt, iron, molybdenum, nickel, tungsten, platinum, and palladium, as well as their sulfides and oxides: can be used alone or in combination with other suitable catalysts; and can, if desired, be typically supported on alumina or silica alumina. A preferred catalyst is cobalt-molybdenum oxide of an alumina support.

The catalyst may be contained in the reactor 44 prior to introducing the pumpable kerogen paste into the reactor 44, or the catalyst may be added to the pumpable kerogen paste prior to introducing the same into the reactor 44. The density/size of the added hydrogenation catalyst particles is preferably an order of magnitude larger than that of the recovered clean kerogen concentrate 36; that is, in the range of between 0.6 to 5 gms/cc in density and between about 50 microns to about 450 microns in average size. More preferably, the catalyst has a density of about 2 gms/cc and an average size of about 200 microns. The catalyst should be larger to facilitate its recovery from the converted hydrocarbon liquid. The concentration of the hydrogenation catalyst added will vary, depending upon reactor conditions, the catalytic nature of the pumpable kerogen paste feed, the desired kerogen conversion level for one or more reactions occurring in the reactor 44, etc.

In a preferred embodiment of the invention, the reactor 44 preferably comprises an upflow expanded catalytic bed, preferably such as the fluidized bed described in U.S. Pat. Nos. 3,207,688, 4,075,081: or the ebullated bed described in U.S. Pat. Nos. 3,888,761, 3,830,728, 3,188,286, 3,271,301, and 3,523,888.

Typical operating pressures in the preferred fluidized or ebullated bed reactor 44 can be from about 50 to about 5,000 psi., preferably from 1,000 to about 3,500 psi.; and most preferably from about 1,500 to about 3,000 psi. The operating temperature may be any reasonable temperature above about 300 degrees Fahrenheit, since below 300 degrees Fahrenheit kerogen will not be efficiently converted from the kerogen paste into a hydrocarbon liquid (i.e., oil). Preferably, the operating temperature can vary from about 600 to 900 degrees Fahrenheit: more preferably from about 700 to about 850 degrees Fahrenheit: and most preferably, the operating temperature is about 800 degrees Fahrenheit.

The space velocity within the reactor 44 for converting kerogen may be any reasonable velocity which accomplishes the desired conversion. Preferably, the space velocity may vary from about 0.05 to about 4.0; and more preferably, the velocity is between about 0.2 and about 4.0. The space velocity is here defined as tons of pumpable kerogen paste feed/hr./cu. ft. of reactor 44.

In a preferred embodiment of the invention, a hydrogen containing gas 48, preferably hydrogen, is utilized to assist in converting the kerogen in the pumpable kerogen paste into a hydrocarbon liquid. The hydrogen concentration in the hydrocarbon gas 48 stream is not critical to the conversion of kerogen, but is important to the quality of oil production. A specified partial pressure should be maintained to prevent polymerization of the oil and promote removal of nitrogen, sulfur and oxygen from the liquid product. In a preferred embodiment, any hydrogen-rich gas stream can be used, such as an off-gas stream of 65 mole percent hydrogen. It should be understood that it is possible not to have hydrogen in the reactor and convert the kerogen.

The hydrogen containing gas 48 may be admixed with the liquid means, such as the preferred hydrocarbon liquid or the recycled hydrocarbon liquid 47, prior to mixing with the recovered clean kerogen concentrate 36, or the hydrogen containing gas 48 may be admixed with the hydrocarbon liquid or the recycled hydrocarbon liquid 47 prior to heating the hydrocarbon liquid, or the recycled hydrocarbon liquid 47. The hydrocarbon containing gas 48 may be mixed with the pumpable paste after it is heated. The hydrogen containing gas may also be mixed with the pumpable kerogen paste prior to introducing the same into the reactor 44, or it may be introduced into the reactor 44, after the pumpable kerogen paste has been introduced. Preferably, the hydrogen containing gas 48 is mixed with the kerogen paste prior to its admittance into the reactor 44, or the hydrogen containing gas 48 is flowed into the reactor after the kerogen paste has been introduced. More preferably, the hydrogen containing gas 48 flows into the reactor 44 after the kerogen paste has been pumped into the reactor 44.

The hydrocarbon gas 48 flow into the reactor 44 may be any reasonable flow to accomplish the desired objects of the invention. Preferably, the flow into the reactor 44 is from about 2,000 to about 10,000 scf. per ton of pumpable kerogen paste feed, with a more preferred rate of about 5,000 scf., based on one ton of pumpable kerogen paste feed.

The hydrocarbon gas 48 has to remain in contact with the pumpable kerogen paste in the reactor 44 for a period of time sufficient enough to assist in the desired conversion of the kerogen into oil. The contact time depends on the reactor temperature and pressure. I have discovered that a contact time of at least 0.5 minute is desired, with a preferred contact time of between about 2 minutes to about 60 minutes, and a more preferred contact time of between about 5 minutes to about 15 minutes when the reactor is heated to 950 degrees Fahrenheit and under a pressure of about 1,500 psig.

The kerogen in the pumpable kerogen paste is converted in the reactor 44 into shale oil while mineral impurities such as calcium carbonate remain unaffected because of the relatively mild treatment temperature. Oxygen in the kerogen is converted into steam, nitrogen is converted into ammonia, and sulfur is converted into hydrogen sulfide. Other impurities in the kerogen go through a conversion of some kind. For example, the arsenic precipitates on the shale oil minerals that accompany the kerogen concentrate. The vent gases 50 from the reactor 44 comprises hydrogen which can be recycled into the reactor 44 or admixed with the pumpable kerogen paste and a significant amount of gaseous sulfur and nitrogen compounds, such as $H_2S$ and $NH_3$, and a minor amount of $CH_4$ and $C_2H_6$. Because of the pressure, these gases can be scrubbed out economically and sold.

The upgraded oil product leaving the reactor 44 is sent downstream through a let-down valve 52 for pressure reduction and into a filter 54 to filter out solids 56, such as calcium carbonate and other residual miscellaneous host rock compounds, for disposal or for further processing and use. The upgraded oil 58 from the filter 54 may then be sent to refining, in accordance with known technology. This upgraded oil 58 has considerably better quality than retorted oil products. A distillation cut stream of this oil may be recycled to be mixed with the recovered clean kerogen concentrate 36 to form the pumpable kerogen paste. The preferred distillation cuts for admixing are those above about +650 degrees Fahrenheit in order to minimize the heavy cuts that must be sent to the refinery because they possess superior hydrogen donor solvent properties.

It is understood that the mixture of converted shale oil, gases and solids in the reactor 44 may be withdrawn separately from the reactor 44, or in a preferred embodiment of the invention, together in the reactor overhead. When withdrawn together from the reactor overhead, they may be separated into various phases and constituents, according to known technology. As was previously mentioned, the gaseous phase may be treated to separate such components as $H_2S$, $NH_3$ and light hydrocarbons from hydrogen such that hydrogen can be recycled, along with any make-up hydrogen for use in the process. Similarly, as was also previously mentioned, the upgraded hydrocarbon liquid phase 58 may be separated into various cuts similar to those found in a typical refinery, with one or more of the cuts, preferably cut(s) above about +650 degrees Fahrenheit, being used as the slurrying liquid for the recovered clean kerogen concentrate 36 to form pumpable kerogen paste. The solid mineral residue 56 recovered from the filter 54 may be treated to remove absorbed gaseous and liquid constituents in order that the residue 56 may be used as fill material for an oil shale deposit, road building material, feed material for a metals extraction process, etc.

The superficial fluid (liquid plus gas) velocity determines the cross-sectional area of the reactor 44 and is critical to elutriate or carry-over the fine solids which accompany kerogen as a part of the effluent, but not to elutriate catalyst materials. The total volume of the reactor 44 is fixed by space velocity. However, because each ton of the recovered clean kerogen concentrate 36 from the second stage filtration 30 contains about 100 to 150 gallons of pure kerogen compared to about 25 gallons of pure kerogen per ton of original crushed oil shale 12, the reactor 44 of this invention can be much smaller than a prior art retort reactor. Because in a preferred embodiment of the invention the reactor 44 comprises a fluidized or ebullated catalytic bed and the mixture of converted shale oil, gases and solids are withdrawn together from the reactor overhead, the hydrogenation catalyst particle size and density are such that they may be recovered with the recovered clean kerogen concentrate. When the hydrogenation catalyst is used in the reactor 44 or in the pumpable kerogen paste feed, the overhead effluent of the reactor 44 is designed to include some spent hydrogenation catalyst particles in the mixture of gases, liquids and solids. For those skilled in the art, variation of no previously mentioned catalyst density and size can be accommodated in the process of this invention.

My invention will be illustrated by the following set-forth examples which are given by way of illustration and not by any limitation. All parameters such as concentrations, mixing proportions, temperatures, pressure, rates, compounds, etc., submitted in these examples are not to be construed to unduly limit the scope of my process for the production and solvent refining of beneficiated shale kerogen.

EXAMPLE I

Shale (10,000 tons/day) from Cathedral Bluffs, Piceance Basin, Colorado, is crushed (9,000 tons/day) and screened for retorting by conventional means. The losses to fines which cannot be processed in a conventional retort are 1,000 tons/day. Fischer Assay are 25 gals./ton. The shale oil produced is 5,357 Bbls./day, which is calculated by $$\frac{9{,}000 \times 25}{42} \ \frac{\text{Ton}}{\text{Day}} \times \frac{\text{Gallons}}{\text{Ton}} \times \frac{\text{Bbls.}}{\text{Gallons}},$$

and oil losses to fines are 595 Bbls./day, which is calculated by $$\frac{1{,}000 \times 25}{42} \ \frac{\text{Ton}}{\text{Day}} \times \frac{\text{Gallons}}{\text{Ton}} \times \frac{\text{Bbls.}}{\text{Gallons}}$$

A second identical shale sample (10,000 tons/day) is crushed (9,500 tons/day) and ground (with losses of 500 tons/day) at a temperature of about 20 degrees centigrade into a product including liberated kerogen and having an average fineness of about 150 microns. The surface of the first product is treated with +800 degrees Fahrenheit cut of shale oil in a conditioning tank at a ratio of 1.5 lbs. of collector/ton of first product and is introduced into a 25 degree centigrade first water medium having a pH of 6.5 and 0.1% by weight of pine oil. The first water medium is aerated and agitated continuously in a conventional Denver cell at the rate of 150 scf./min./sq. ft. cell of air and 1,400 ft./min. tip speed of rotor impeller, respectively. Liberated kerogen having an average fineness of 150 microns attaches to the rising bubbles of aeration where it collects in the foam on top of the first water medium. The collected 150 microns (average) liberated kerogen is skimmed off from the surface of the first water medium and ground at a temperature of 20 degrees centigrade into a second product including clean kerogen and having an average fineness of 20 microns. The disposal of tailings is 8,150 tons/day at a Fischer Assay of 1.6 gallons/ton. The surface of the second product is treated with 300 degrees Fahrenheit cut of shale oil in a conditioning tank at a rate of 1.5 lbs. of collector/ton of first product and is introduced into a 25 degrees centigrade second water medium having a pH of 6.5 and 0.1% by weight of pine oil. The second water medium with a 100 sq. ft. surface area is aerated continuously from the bottom at the rate of 1000 scf./min./sq. ft. Clean kerogen having an average fineness of 20 microns attaches to the rising bubbles of aeration where it collects in the foam on top of the second water medium. The collected 20 microns (average) clean kerogen concentrate is skimmed off from the surface of the second water medium at the rate of 1,850 tons/day with a Fischer Assay of 128 gallons/ton and blended with +850 degrees Fahrenheit fractionation cut of shale oil in a ratio of 15 Bbls. of shale oil/ton of concentrate to form a pumpable kerogen paste which is fed to a reactor having a temperature of 800 degrees Fahrenheit and a pressure of 1,000 psi. The kerogen paste remains in the reactor for 30 minutes. The shale oil produced is 7,893 Bbls./day, which is calculated by $$\frac{1{,}850 \times 1.4 \times 128}{42} \ \frac{\text{Ton}}{\text{Day}} \times \frac{\text{Gallons}}{\text{Ton}} \times \frac{\text{Bbls.}}{\text{Gallons}},$$

and oil losses to tailings and fines are 608 Bbls./day, which is calculated as follows:

To fines:

$$\frac{500 \times 25}{42} \ \frac{\text{Tons}}{\text{Day}} \times \frac{\text{Gals.}}{\text{Tons}} \times \frac{\text{Bbls.}}{\text{Gals.}} = 298$$

To tailings:

$$\frac{8{,}150}{42} \times 1.6 \ \frac{\text{Ton}}{\text{Day}} \times \frac{\text{Gallons}}{\text{Ton}} \times \frac{\text{Bbls.}}{\text{Gallons}} = 310$$

Total 608 Bbls./day

The oil recovery in the reactor exceeds the recovery predicted by the Fischer Assay by 40% to produce an equivalent of 7,893 Bbls./day of shale oil from an equivalent of 10,000 tons/day, compared with only 5,357 Bbls./day that is produced by conventional retorting. The weight of the calcined tailings from 9,000 tons/day, which are environmentally harmful, is reduced essentially to zero.

EXAMPLE II

Repeat Example I but instead of aerating the treated first and second product in the first and second water medium, separate out the kerogen by gravity as disclosed by Guerre in U.S. Pat. No. 4,348,274 and find that the Bbls./day of shale oil recovered are less than 6,000 Bbls/day.

EXAMPLE III

A 2,000 gm sample of 25 gallons/ton oil shale by Fischer Assay is ground to average fineness of 15 microns (sizes range from 5 microns to 250 microns). Grinding to required size is conducted at 15 degrees centigrade. It is mixed with 2,500 gm of water, 5 gms of pine oil frother and 25 gms shale oil derived collector. A rougher concentrate of 900 gms is recovered with oil grade of 50 gallons/tons, and 1,100 gms of rougher tailings are disposed containing 0.45 gallons/tons of Fischer Assay oil. Aeration at a rate of 10 scf./min./sq. ft. with 0.1% by weight of pine oil and with mechanical agitation at an average pulp density of 30% solids is conducted at 25 degrees centigrade.

The 900 gms of concentrate is reground in water at 15 degrees centigrade to reduce its size to an average size of 20 microns. Additional 15 gms shale oil derived collector is added and the aeration process at the rate of 13 scf./min./sq. ft. is repeated with 0.1% by weight of pine oil as the frother and with mechanical agitation at an average pulp density of 30% solids. Cleaner concentrates weighing 405 gms are recovered which contain 100 GPT (Fischer) of shale oil. The cleaner tailings which contain 9.1 GPT shale oil (Fischer) are recycled to the feeding end of the rougher aeration. Oil recovery is 90% of 100 GPT of kerogen concentrates.

EXAMPLE IV

Repeat Example III without mechanical agitation in the cleaner stage (the second stage). The quantity of cleaner concentrates now amounts to 380 gms of 100 GPT (Fischer). Aeration without mechanical agitation produces a more desirable product.

EXAMPLE V

Cleaner concentrates from Example IV are charged into a solvent refined kerogen ebullated bed reactor, blended with +650 degrees Fahrenheit cut shale oil in a ratio of 15 Bbls. of cut shale oil/ton of concentrate. Hydrogen (4,000 scf./ton of fed pumpable kerogen paste) is introduced at the feed end of the reactor. The reaction is conducted at 1,000 psi. and 850 degrees Fahrenheit with a suitable nickel/molybdenum catalyst in the ebulated bed. The space velocity is about 2 tons of pumpable kerogen paste feed/hr./cu. ft. of reactor. Residence time in the reactor is 30 minutes. Table 1 compares the quality of the oil which is recovered by hydrogen and with/without catalyst and that which is with typical raw shale oil.

TABLE I

QUALITY COMPARISON FROM THREE SHALE OIL RECOVERY PROCESSES

| Column 1 | Column 2 Retort Shale | Column 3 Solvent Refined Kerogen Shale (with $H_2$ and without catalyst) | Column 4 Solvent Refined Kerogen Shale (with hydrogen and catalyst |
|---|---|---|---|
| API Gravity | 12.0 | 30.5 | 44.0 |
| Specific Gravity | 0.9861 | 0.8735 | 0.8063 |
| Hydrogen, Wt. % | 9.8 | 12.5 | 15.6 |
| Nitrogen, Wt. % | 1.1 | 0.5 | 0.0004 |
| Oxygen, Wt. % | 2.0 | 0.03 | 0.0003 |
| Sulfur, Wt. % | 3.9 | 1.5 | 0.001 |

TABLE I-continued

QUALITY COMPARISON FROM THREE SHALE OIL RECOVERY PROCESSES

| Column 1 | Column 2 Retort Shale | Column 3 Solvent Refined Kerogen Shale (with $H_2$ and without catalyst) | Column 4 Solvent Refined Kerogen Shale (with hydrogen and catalyst |
|---|---|---|---|
| Arsenic, Wt. % | 0.0001 | 0.0001 | 0.000001 |

Shale oil from the solvent refined kerogen is distilled under atmospheric pressure. Table 2 compares the distillation data of the solvent refined kerogen oil of Table I, Columns 3 and 4, with that of a retorting process.

TABLE 2

| Column 1 Vol. % | Column 2 Retort Oil | Column 3 Solvent Refined Kerogen Oil (with hydrogen and without catalyst) | Column 4 Solvent Refined Kerogen Oil (with $H_2$ and catalyst) |
|---|---|---|---|
| Initial Boiling Point | 387 | 380 | 180 |
| 10 | 530 | 520 | 430 |
| 30 | 640 | 650 | 530 |
| 50 | 716 | 713 | 600 |
| 70 | 747 | 750 | 698 |
| 90 | 790 | 800 | 800 |

The solvent refined kerogen process increases the proportions of light distillation cuts of the shale oil significantly (50 volume percent boiling below 600 degrees Fahrenheit by conventional retorting). The concentrates of deleterious nitrogen and sulfur components are greatly reduced.

EXAMPLE VI

Cleaner concentrates from Example IV are charged into a solvent refined kerogen reactor blended with +650 degrees Fahrenheit cut shale oil in a ratio of Example V. No hydrogen is introduced or used in this reactor. No catalyst is used in this reactor. Pressure is maintained at 1,000 psig. and temperature is 850 degrees Fahrenheit. The quantity of oil recovered is the same as indicated in Example I, but produced in a retort. This shows that it is not essential to use hydrogen but it is desirable if high-quality liquid products are to be maintained.

EXAMPLE VII

Cleaner concentrates are charged into a solvent refined kerogen reactor (which contains no catalyst) and are treated under the conditions of Example V. The liquid oil produced contains 0.5 wt. % nitrogen and 1.5 wt. % sulfur, but the distillation characteristics of the oil are identical to those in Table 2 of Example V. The catalyst lowers the nitrogen and sulfur content of the liquid oil.

EXAMPLE VIII

Repeat Example I but at a temperature in each instance of 60 degrees centigrade instead of 20 degrees centigrade or 25 degrees centigrade. The amount of rougher concentrates that is recovered is increased to 1,200 gms but the grade is reduced to less than 40 GPT (Fischer). Smearing of the kerogen from the higher temperatures decreases the grade.

EXAMPLE IX

Shale concentrates are premixed with 850 degrees Fahrenheit shale oil cut and are introduced into a fixed catalytic bed reactor containing the identical catalyst of Example V. Residence time in the reactor is 30 minutes. After 30 equivalent reactor volumes of concentrate paste feeding, the reactor plugged with inert material from the kerogen concentrate. The reactor has to be dismantled for cleaning. An equivalent slurry of shale oil/kerogen concentrate slurry is introduced into an ebullated bed reactor. The reactor operates for 3 days continuously and is dismantled for inspection after voluntary shutdown. A reactor with a fixed catalytic bed plugs, whereas an expanded bed reactor (i.e., ebullated bed) does not plug.

EXAMPLE X

Repeat Example I but prior to treating the first and second product with the collector, the first and second product are treated with starch to depress flotation of undesirable non-kerogen minerals in a conditioning tank at a ratio of 3 lbs. of starch/ton of product. Eighteen Hundred (1800) tons of concentrate are recovered but the grade of the concentrate is increased to 135 gals/-ton. Thus, 8,100 Bbls. of oil are produced. The loss to the tailings is reduced from 310 Bbls./day to 103 Bbls./day because of the improved concentrate grade.

While the present invention has been described herein with reference to particular embodiments thereof and examples therefor, a latitude of modification, various changes and substitutions are intended in the foregoing disclosure and it will be appreciated that in some instances some features of the invention will be employed without a corresponding use of other features without departing from the scope of the invention as set forth.

I claim:

1. A process for the production and conversion of solid shale kerogen to produce shale oil comprising in serial combination the steps of:

(a) grinding crushed shale into a first product consisting essentially of generally inert matter and generally liberated solid kerogen having an average fineness of between about 5 microns to about 250 microns;

(b) treating the surface of the first product including the ground-liberated solid kerogen of step (a) with a first collector in order to render the ground liberated solid kerogen air-avid and water-repellent;

(c) introducing the ground-treated first product of step (b) into a first water suspension medium having a first frother;

(d) suspending the ground-treated first product in the first water suspension medium by a first means for agitation;

(e) aerating the first water suspension medium in order to form a layer of foam on top of the first water suspension medium such that air-avid treated liberated solid kerogen having a fineness of between about 5 microns to about 250 microns attaches to the rising bubbles of aeration where it collects in the foam;

(f) skimming off the collected liberated solid kerogen from the surface of the first water suspension medium in order to recover liberated solid kerogen having an average fineness of between about 5 microns to 250 microns;

(g) grinding the recovered liberated solid kerogen of step (f) into a second product consisting essentially of generally disassociated inert matter and generaly clean solid kerogen having an average fineness of between about 0.5 microns to about 45 microns;

(h) treating the surface of the second product including the ground-clean solid kerogen with a second collector in order to render the ground-clean solid kerogen air-avid and water-repellent;

(i) introducing the ground-treated second product of step (h) into a second water suspension medium having a second frother;

(j) aerating the second water suspension medium having the second frother of step (i) in order to form a second layer of foam on top of the second water suspension medium such that air-avid treated clean solid kerogen having a fineness of between about 0.5 to 45 microns attaches to the rising bubbles of aeration where it collects in the foam;

(k) skimming off the collected clean solid kerogen product from the surface of the second water suspension medium in order to recover a clean solid kerogen product having an average fineness of between about 0.5 to 45 microns;

(l) mixing the recovered clean solid kerogen product of step (k) with a liquid means to form a pumpable solid kerogen paste;

(m) introducing the pumpable solid kerogen paste of step (k) into at least one reaction zone maintained at a pressure of between about 50 and about 5,000 psi. and a temperature of between about 300 degrees Fahrenheit and about 1,000 degrees Fahrenheit in order to convert the solid kerogen in the pumpable solid kerogen paste into a hydrocarbon liquid; and (n) removing the converted hydrocarbon liquid of step (m) and associated gases from the reaction zone.

2. The process of claim 1 additionally comprising introducing a hydrogen containing gas into the reaction zone after introducing step (m) in order to contact the pumpable kerogen paste to prevent coke formation in the pumpable kerogen paste which is converted into a hydrocarbon liquid.

3. The process of claim 1 additionally comprising admixing the pumpable kerogen paste of step (l) with a hydrogen containing gas prior to said introducing step (m).

4. The process of claim 1 additionally comprising admixing the liquid means with a hydrogen containing gas prior to said liquid means being mixed with said recovered clean kerogen product.

5. The process of claim 1 additionally comprising drying the recovered 0.5 to 45 microns of fine kerogen product of step (k) prior to said mixing step (l).

6. The process of claim 5 wherein said drying is by filtering.

7. The process of claim 1 additionally comprising adding a hydrogenation catalyst to the reaction zone prior to said introducing step (m).

8. The process of claim 1 wherein said introducing step (m) for converting kerogen is at a space velocity of between about 0.05 and about 4.0 tons of pumpable kerogen paste feed/hr./cu. ft. of reaction zone.

9. The process of claim 1 additionally comprising separating the reaction effluent into two or more component streams.

10. The process of claim 2 wherein the amount of hydrogen containing gas introduced varies from about 2,000 to about 10,000 scf. per ton of feed pumpable kerogen paste.

11. The process of claim 9 wherein the added liquid means is a hydrocarbon recycle stream from the effluent stream separation process.

12. The process of claim 1 wherein the liquid means in Bbls/ton of clean kerogen product ratio of pumpable kerogen paste feed varies from about 5:1 to about 50:1.

13. The process of claim 2 wherein said pumpable kerogen paste is contacted with the hydrogen containing gas for at least 0.5 minutes.

14. The process of claim 1 wherein said suspending of the ground-treated first product in the first water suspension by said first means for agitation in step (d) is at an average pulp density of between about 10 to about 45% solids; said first means for agitation includes a first impeller speed tip means and the rate of agitation of said first means for agitation is between about 5 and 2,000 ft./min. with said first impeller speed tip means.

15. The process of claim 1 additionally comprising suspending the ground-treated second product in the second water suspension medium by a second means for agitation and at an average pulp density of between about 10 to about 45% solids prior to said aerating step (j); said second means for agitation includes a second impeller speed tip means and the rate of agitation of said second means for agitation is between about 5 and 2,000 ft./min. with said second impeller speed tip means.

16. The process of claim 1 wherein said grinding step (a) and (g) and said treating steps (b) and (h) are at a temperature of between about 0 degrees centigrade and 50 degrees centigrade.

17. The process of claim 1 wherein said first water suspension medium and said second water suspension medium have a temperature of between about 0 degrees centigrade and 50 degrees centigrade.

18. The process of claim 1 wherein said clean kerogen product of step (k) contains at least 40% by weight of pure kerogen.

19. The process of claim 1 wherein at least 50% by weight of the kerogen in the pumpable kerogen paste is converted into a hydrocarbon liquid by said introducing step (m).

20. The process of claim 1 wherein said liquid means of step (l) is a hydrocarbon liquid means.

21. The process of claim 1 wherein said treating step (b) comprises filming the surfaces of the first product with the first collector in a first conditioning zone at a ratio of between about 0.005 to about 10.0 lbs. of the first collector per ton of the first product.

22. The process of claim 1 wherein said treating step (h) comprises filming the surfaces of the second product with the second collector in a second conditioning zone at a ratio of between about 0.005 to about 10.0 lbs. of the second collector per ton of the second product.

23. The process of claim 1 additionally comprising filming the surface of the first product prior to said treating step (b) with a first modifying agent in a first modifying conditioning zone at a ratio of between about 0.05 to about 10.0 lbs. of the first modifying agent per ton of the first product.

24. The process of claim 23 wherein said first modifying agent is a depressant selected from the group consisting of ligno sulfates, starch, gelatin, saponin, quebracho, sodium metaphosphate, sodium silicate, dextrin, aluminum hydroxide, iron hydroxide, lime, and mixtures thereof.

25. The process of claim 23 wherein said first modifying agent is an activator selected from the group consisting of sulfuric acid, sodium hydroxide, calcium hydroxide, and mixtures thereof.

26. The process of claim 1 additionally comprising filming the surfaces of the second product prior to said treating step (h) with a second modifying agent in a second modifying conditioning zone at a ratio of between about 0.05 to about 10.0 lbs. of the second modifying agent per ton of the second-stage product.

27. The process of claim 26 wherein said second modifying agent is a depressant selected from the group consisting of ligno sulfates, starch, gelatin, saponin, quebracho, sodium metaphosphate, dextrin, aluminum hydroxide, iron hydroxide, lime, sodium silicate, and mixtures thereof.

28. The process of claim 26 wherein said second modifying agent is an activator selected from the group consisting of sulfuric acid, sodium hydroxide, calcium hydroxide, and mixtures thereof.

29. The process of claim 1 wherein said first collector is selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof.

30. The process of claim 1 wherein said second collector is selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof.

31. The process of claim 1 wherein said first frother is selected from the group consisting of methyl amyl alcohol, methylisobutylcarbinol, polypropylene glycol ether, pine oil, cresylic acid, terpinol, pentandiol, and mixtures thereof; and said first frother comprises between 0.01 to about 0.50% by weight of said first water suspension medium.

32. The process of claim 1 wherein said second frother is selected from the group consisting of methyl amyl alcohol, methylisobutylcarbinol, polypropylene glycol ether, pine oil, cresylic acid, terpinol, pentandiol, and mixtures thereof.

33. The process of claim 1 wherein said first and said second water suspension medium have a pH of between about 5 and 10, said aerating steps (e) and (j) are at a rate of between 5 and 15 cubic feet per minute per square foot of the surface of the water suspension medium being aerated, and are aerated from between about ½ minute to about 2 hours.

34. The process of claim 1 wherein said pumpable kerogen paste of step (l) is introduced at a temperature of between about 100 degrees Fahrenheit and 900 degrees Fahrenheit.

35. The process of claim 7 wherein said hydrogenation catalyst has a density of between about 0.6 to 5 gms/cc and an average size of between about 50 microns to about 450 microns.

36. The process of claim 7 wherein said hydrogenation catalyst is selected from the group consisting of cobalt, iron, molybdenum, nickel, tungsten, platinum, palladium, and their oxides, and their sulfides, and mixtures thereof.

37. A process for the production and conversion of shale kerogen to produce shale oil comprising in serial combination the steps of:

(a) grinding crushed shale at a temperature of between about 0 degrees centigrade to about 50 degrees centigrade into a first product consisting essentially of generally inert matter and generally liberated kerogen having an average fineness of between about 5 microns to about 250 microns;

(b) treating in a first conditioning zone the surface of the first product including the ground-liberated kerogen of step (a) with a first collector selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof, at a ratio of between about 0.005 to about 10.0 lbs. of the first collector per ton of the first product and at a temperature of between about 0 degrees centigrade to about 50 degrees centigrade in order to render the ground-liberated kerogen air-avid and water-repellent;

(c) introducing the ground-treated first product of step (b) into a first water suspension medium having a pH of between about 5 and 10 and between about 0.01 to about 0.50% by weight of a first frother selected from the group consisting of methyl amyl alcohol, methylisobutylcarbinol, polypropylene glycol ether, pine oil, cresylic acid, terpinol, pentandiol, and mixtures thereof, and a temperature of between about 0 degrees centigrade and 50 degrees centigrade;

(d) suspending the ground-treated first product in the first water suspension medium by a first means for agitation at an average pulp density of between about 10 to about 45% solids and at a rate of between about 5 and 2000 ft./min. with an impeller speed tip means;

(e) aerating at a rate of between about 5 and and 15 cubic feet per minute per square foot of the surface of the first water suspension medium and from between ½ minute to about 2 hours, the first water suspension medium having the first frother of step (c) in order to form a layer of foam on top of the first water suspension medium such that air-avid treated liberated kerogen having an average fineness of between about 5 microns to about 250 microns attaches to the rising bubbles of aeration where it collects in the foam;

(f) skimming off the collected liberated kerogen from the surface of the first water suspension medium in order to recover liberated kerogen having an average fineness of between about 5 microns to 250 microns;

(g) grinding at a temperature of between about 0 degrees centigrade to about 50 degrees centigrade the recovered liberated kerogen of step (e) into a second product consisting essentially of generally disassociated inert matter and generally clean kerogen having an average fineness of between about 0.5 microns to about 45 microns;

(h) treating in a second conditioning zone the surface of the second product including the ground-clean kerogen with a second collector selected from the group consisting of tall oil, lignin, tallow, kerosene, shale oil fractionation products, methyl octadecyl amino, lauryl amino hydrocholoride, sodium oleate, oleic acid, linoleic acid, linolenic acid, and mixtures thereof, at a ratio of between about 0.005 to about 10.0 lbs. of the second collector per ton of the second product and at a temperature of between about 0 degrees centigrade and about 50 degrees centigrade in order to render the ground-clean kerogen air-avid and water-repellent;

(i) introducing the ground-treated second product of step (h) into a second water suspension medium having a pH of between about 5 and 10 and between about 0.01 to about 0.50% by weight a second frother selected from the group consisting of methyl amyl alcohol, methylisobutylcarbinol, polypropylene glycol ether, pine oil, cresylic acid, terpinol, pentandiol, and mixtures thereof, and having a temperature of between about 0 degrees centigrade and 50 degrees centigrade;

(j) aerating at a rate of between about 5 and 15 cubic feet per minute per square foot of the surface of the second water suspension medium and from between ½ minute to about 2 hours the second water suspension medium in order to form a second layer of foam on top of the second water suspension medium such that air-avid treated clean kerogen having a fineness of between about 0.5 to 45 microns attaches to the rising bubbles of aeration where it collects in the foam;

(k) skimmng off the collected clean kerogen product having at least 40% by weight of pure kerogen from the surface of the second water suspension medium in order to recover a clean kerogen product having an average fineness of between about 0.5 to 45 microns and containing at least 40% by weight of pure kerogen;

(l) mixing the recovered clean kerogen product of step (k) with a hydrogen liquid means to form a pumpable kerogen paste, and the liquid means in Bbls./ton of clean kerogen product ratio of pumpable kerogen paste feed varies from about 5:1 to about 50:1;

(m) introducing at a temperature of between about 100 degrees Fahrenheit and 900 degrees Fahrenheit the pumpable kerogen paste of step (l) into at least one reaction zone at a space velocity of between about 0.05 and about 4.0 of tons pumpable kerogen paste feed/hr./cu. ft. of reaction zone and wherein the reaction zone is maintained at a pressure of between about 50 and about 5,000 psi. and a temperature of between about 300 degrees Fahrenheit and about 1,000 degrees Fahrenheit in order to convert at least 50% by weight of the kerogen in the pumpable kerogen paste into a hydrocarbon liquid; and (n) removing the converted hydrocarbon liquid of step (m) and associated gases from the reaction zone.

38. A process for the production and conversation of solid shale kerogen to produce shale oil comprising in serial combination the steps of:

(a) grinding crushed shale into a first product consisting essentially of generally inert matter and generally liberated solid kerogen having an average fineness of between about 5 microns to about 250 microns;

(b) treating the surface of the first product including the ground-liberated solid kerogen of step (a) with a first collector in order to render the ground-liberated solid kerogen air-avid and water-repellent;

(c) introducing the ground-treated first product of step (b) into a first water suspension medium having a first frother;

(d) suspending the ground treated first product in the first water suspension medium by a first means for agitation;

(e) aerating the first water suspension medium in order to form a layer of foam on top of the first water suspension medium such that air-avid treated liberated solid kerogen having a fineness of between about 5 microns to about 250 microns attaches to the rising bubbles of aeration where it collects in the foam;

(f) skimming off the collected liberated solid kerogen from the surface of the first water suspension medium in order to recover liberated solid kerogen having an average fineness of between about 5 microns to 250 microns;

(g) grinding of the recovered liberated solid kerogen of step (f) into a second product consisting essentially of generally disassociated inert matter and generally clean solid kerogen having an average fineness of between about 0.5 microns to about 45 microns;

(h) treating the surface of the second product including the ground-clean solid kerogen with a second collector in order to render the ground-clean solid kerogen air-avid and water-repellent;

(i) introducing the ground-treated second product of step (j) into a second water suspension medium having a second frother;

(j) aerating the second water suspension medium having the second frother step (i) in order to form a second layer of foam on top of the second water suspension medium such that air-avid treated clean solid kerogen having a fineness of between about 0.5 to 45 microns attaches to the rising bubbles of aeration where it collects in the foam;

(k) skimming off the collected clean solid kerogen product from the surface of the second water suspension medium in order to recover a clean solid kerogen product having an average fineness of between about 0.5 to 45 microns;

(l) mixing the recovered clean solid kerogen product of step (k) with a liquid means to form a pumpable solid kerogen paste;

(m) introducing the pumpable solid kerogen paste of step (l) along with a hydrogen containing gas into at least one upflow expanded catalytic bed reaction zone, at a superficial velocity sufficient to move the reaction mixture of gases, liquids and solids upwardly through the reactor and wherein the reaction zone is maintained at a pressure of between about 50 and about 5,000 psi. and a temperature of between about 300 degrees Fahrenheit and about 1,000 degrees Fahrenheit, in order to convert the solid kerogen in the pumpable solid kerogen paste into a hydrocarbon liquid;

(n) removing the reaction mixture including the converted hydrocarbon liquid of step (m) and associated gases from the reaction zone as total overhead effluent; and (o) separating the reactor effluent into two or more component streams.

39. The process of claim 38 additionally comprising said introducing step (m) comprises a space velocity between about 0.05 and 4.0 tons of pumpable kerogen paste feed/hr./cu. ft. of reaction zone.

40. The process of claim 38 additionally comprising drying the recovered 0.5 to 45 microns of fine kerogen product of step (k) prior to said mixing step (l).

41. The process of claim 40 wherein said drying is by filtering.

42. The process of claim 38 wherein said catalytic bed comprises a hydrogenation catalyst.

43. The process of claim 42 wherein said expanded bed is a fluidized bed.

44. The process of claim 42 wherein said expanded bed is an ebullated bed.

45. The process of claim 38 wherein the amount of hydrogen containing gas introduced varies from about 2,000 to about 10,000 scf. per ton of feed pumpable kerogen paste.

46. The process of claim 38 wherein said liquid means is a hydrocarbon liquid and the added hydrocarbon liquid is a hydrocarbon recycled stream from the effluent stream separation process.

47. The process of claim 38 wherein the liquid means clean kerogen product ratio of pumpable kerogen paste feed varies from about 5:1 to about 50:1.

48. The process of claim 38 wherein said suspending of the ground-treated first product in the first water suspension medium by said first means for agitation in step (d) is at an average pulp density of between about 10 to about 45% solids; said first means for agitation includes a first impeller speed tip means and the rate of agitation of said first means for agitation is between about 5 and 2,000 ft./min. with an impeller speed tip means.

49. The process of claim 38 additionally comprising suspending the ground treated second product in the second water suspension medium by a second means for agitation and at an average pulp density of between about 10 to about 45% solids prior to said aerating step (j); said second means for agitation includes second impeller speed tip means and the rate of agitation of said second means for agitation is between about 5 and 2,000 ft./min. with said second impeller speed tip means.

50. The process of claim 38 wherein said grinding steps (a) and (g) and said treating steps (b) and (h) are at a temperature of between about 0 degrees centigrade and 50 degrees centigrade.

51. The process of claim 38 wherein said first water suspension medium and said second water suspension medium have a temperature of between about 0 degrees centigrade and 50 degrees centigrade.

52. The process of claim 38 wherein said clean kerogen product of step (k) contains at least 40% by weight of pure kerogen.

53. The process of claim 38 wherein at least 50% by weight of the kerogen in the pumpable kerogen paste is converted into a hydrocarbon liquid by said introducing step (m).

54. The process of claim 38 wherein said liquid means of step (l) is a hydrocarbon liquid means.

55. The process of claim 38 wherein said treating step (b) comprises filming the surfaces of the first product with the first collector in a first conditioning zone at a ratio of between about 0.005 to about 10.0 lbs. of the first collector per ton of the first product.

56. The process of claim 38 wherein said treating step (h) comprises filming the surfaces of the second product with the second collector in a second conditioning zone at a ratio of between about 0.005 to about 10.0 lbs. of the second collector per ton of the second product.

57. The process of claim 38 additionally comprising filming the surface of the first product prior to said treating step (b) with a first modifying agent in a first modifying conditioning zone at a ratio of between about 0.05 to about 10.0 lbs. of the first modifying agent per ton of the first product.

58. The process of claim 57 wherein said first modifying agent is a depressant selected from the group consisting of ligno sulfates, starch, gelatin, saponin, quebracho, sodium metaphosphate, dextrin, aluminum hydroxide, iron hydroxide, lime, sodium silicate, and mixtures thereof.

59. The process of claim 57 wherein said first modifying agent is an activator selected from the group consisting of sulfuric acid, sodium hydroxide, calcium hydroxide, and mixtures thereof.

60. The process of claim 38 additionally comprising filming the surfaces of the second product prior to said treating step (h) with a second modifying agent in a second modifying conditioning zone at a ratio of between about 0.05 to about 10.0 lbs. of the second modifying agent per ton of the second-stage product.

61. The process of claim 60 wherein said second modifying agent is a depressant selected from the group consisting of ligno sulfates, starch, gelatin, saponin, quebracho, sodium metaphosphate, dextrin, aluminum hydroxide, iron hydroxide, lime, sodium silicate, and mixtures thereof.

62. The process of claim 60 wherein said second modifying agent is an activator selected from the group consisting of sulfuric acid, sodium hydroxide, calcium hydroxide, and mixtures thereof.

63. The process of claim 38 wherein said first collector is selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof.

64. The process of claim 38 wherein said second collector is selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof.

65. The process of claim 38 wherein said first frother is selected from the group consisting of methyl amyl alcohol, methylisobutylcarbinol, polypropylene glycol ether, pine oil, cresylic acid, terpinol, pentantiol, and mixtures thereof; and said first frother comprises between 0.01 to about 0.50% by weiqht of said first water suspension medium.

66. The process of claim 38 wherein said second frother is selected from the group consisting of methyl amyl alcohol, methylisobutylcarbinol, polypropylene glycol ether, pine oil, cresylic acid, terpinol, pentandiol, and mixtures thereof; and said second frother comprises between 0.01 to about 0.50% by weight of said second water suspension medium.

67. The process of claim 38 wherein said first and said second water suspension medium have a pH of between about 5 and 10; said aerating steps (e) and (j) are at a rate of between about 5 and 15 cubic feet per minute per square foot of the surface of the water suspension medium being aerated and are aerated from between about ½ minute to about 2 hours.

68. The process of claim 38 wherein said pumpable kerogen paste of step (l) is introduced at a temperature of between about 100 degrees Fahrenheit and 900 degrees Fahrenheit.

69. The process of claim 42 wherein said hydrogenation catalyst has a density of between about 0.6 to 5 gms/cc and an average size of between about 50 microns to about 450 microns.

70. The process of claim 44 wherein said hydrogenation catalyst has a density of between about 0.6 to 5 gms/cc and an average size of between about 50 microns to about 450 microns.

71. The process of claim 42 wherein said hydrogenation catalyst is selected from the group consisting of cobalt, iron, molybdenum, nickel, tungsten, platinum, palladium, their oxides, their sulfides, and mixtures thereof.

72. The process of claim 44 wherein said hydrogenation catalyst is selected from the group consisting of cobalt, iron, molydenum nickel, tungsten, platinum, palladium, their oxides, their sulfides, and mixtures thereof.

73. A process for the production and conversion of solid shale kerogen to produce shale oil comprising in serial combination the steps of:

(a) grinding crushed shale into a first product consisting essentially of generally inert matter and generally liberated solid kerogen having an average fineness of between about 5 microns to about 250 microns;

(b) treating the surface of the first product including the ground-liberated solid kerogen of step (a) with a first collector in order to render the ground-liberated solid kerogen air-avid and water-repellent;

(c) introducing the ground-treated first product of step (b) into a first water suspension medium having a first frother;

(d) suspending the ground-treated first product in the first water suspension medium by a first means for agitation;

(e) aerating the first water suspension medium in order to form a layer of foam on top of the first water suspension medium such that air-avid treated liberated solid kerogen having a fineness of between about 5 microns to about 250 microns attaches to the rising bubbles of aeration where it collects in the foam;

(f) skimming off the collected liberated solid kerogen from the surface of the first water suspension medium in order to recover liberated solid kerogen having an average fineness of between about 5 microns to 250 microns;

(g) grinding of the recovered liberated solid kerogen of step (f) into a second product consisting essentially of generally disassociated inert matter and generally clean solid kerogen having an average fineness of between about 0.5 microns to about 45 microns;

(h) treating the surface of the second product including the ground-clean solid kerogen with a second collector in order to render the ground-clean solid kerogen air-avid and water-repellent;

(i) introducing the ground-treated second product of step (h) into a second water suspension medium having a second frother;

(j) aerating the second water suspension medium having the second frother of step (i) in order to form a second layer of foam on top of the second water suspension medium such that air-avid treated clean solid kerogen having a fineness of between about 0.5 to 45 microns attaches to the rising bubbles of aeration where it collects in the foam;

(k) skimming off the collected clean solid kerogen product from the surface of the second water suspension medium in order to recover a clean solid kerogen product having an average fineness of between about 0.5 to 45 microns;

(l) mixing the recovered clean solid kerogen product of step (k) with a liquid means to form a pumpable solid kerogen paste;

(m) introducing the pumpable solid kerogen paste of step (l) into at least one upflow expanded catalytic bed reaction zone, maintained at a pressure of between about 50 to about 5,000 psi. and a temperature of between about 300 degrees Fahrenheit and about 1,000 degrees Fahrenheit;

(n) introducing a hydrogen containing gas into the reaction zone of step (m) in such a manner that the hydrogen containing gas flows upwardly at between about 2,000 to about 10,000 scf. per ton of pumpable solid kerogen paste feed in order to assist converting the solid kerogen in the pumpable solid kerogen paste into a hydrocarbon liquid;

(o) removing the reaction mixture including the converted hydrocarbon liquid of step (n) and associated gases from the reaction zone as total overhead effluent; and (p) separating the reactor effluent into two or more component streams.

74. The process of claim 73 additionally comprising said introducing step (m) having at a space velocity of between about 0.05 and 4.0 tons of pumpable kerogen paste feed/hr./cu. ft. of reaction zone.

75. The process of claim 73 additionally comprising drying the recovered the 0.5 to 45 microns of fine kerogen product of step (k) prior to said mixing step (l).

76. The process of claim 73 wherein said drying is by filtering.

77. The process of claim 73 wherein said expanded catalytic bed comprises a hydrogenation catalyst.

78. The process of claim 77 wherein said expanded catalytic bed reaction zone is a fluidized bed.

79. The process of claim 77 wherein said expanded catalytic bed reaction zone is an ebullated bed.

80. The process of claim 73 wherein said liquid means of step (l) is a hydrocarbon liquid and the added hydrocarbon liquid is a hydrocarbon recycled stream from the effluent stream separation process.

81. The process of claim 73 wherein the liquid means in Bbls./ton of clean kerogen product ratio of pumpable kerogen paste feed varies from about 5:1 to about 50:1.

82. The process of claim 74 wherein said pumpable kerogen paste is contacted with the hydrogen containing gas for at least 0.5 minutes.

83. The process of claim 73 wherein said suspending of the ground-treated first product in the first water suspension medium by said first means for agitation in step (d) is at an average pulp density of between about 10 to about 45% solids; said first means for agitation includes a first impeller speed tip means and the rate of agitation of said first means for agitation is between about 5 and 2,000 ft./min. with said first impeller speed tip means.

84. The process of claim 73 additionally comprising suspending the ground-treated second product in the second water suspension medium by a second means for agitation and at an average pulp density of between about 10 to about 45% solids prior to said aerating step (j); said second means for agitation includes a second impeller speed tip means and the rate of agitation of said second means for agitation is between about 5 and 2,000 ft./min. with an impeller speed tip means.

85. The process of claim 73 wherein said grinding step (a) and (g) and said treating steps (c) and (h) are at a temperature of between about 0 degrees centigrade and 50 degrees centigrade.

86. The process of claim 73 wherein said first water suspension medium and said second water suspension medium have a temperature of between about 0 degrees centigrade and 50 degrees centigrade.

87. The process of claim 73 wherein said clean kerogen product of step (k) contains at least 40% by weight of pure kerogen.

88. The process of claim 73 wherein at least 50% by weight of the kerogen in the pumpable kerogen paste is converted into a hydrocarbon liquid by said introducing step (m).

89. The process of claim 73 wherein said liquid means of step (l) is a hydrocarbon liquid means.

90. The process of claim 73 wherein said treating step (b) comprises filming the surfaces of the first product with the first collector in a first conditioning zone at a ratio of between about 0.005 to about 10.0 lbs. of the first collector per ton of the first product.

91. The process of claim 73 wherein said treating step (h) comprises filming the surfaces of the second product with the second collector in a second conditioning zone at a ratio of between about 0.005 to about 10.0 lbs. of the second collector per ton of the second product.

92. The process of claim 73 additionally comprising filming the surface of the first product prior to said treating step (b) with a first modifying agent in a first modifying conditioning zone at a ratio of between about 0.05 to about 10.0 lbs. of the first modifying agent per ton of the first stage product.

93. The process of claim 92 wherein said first modifying agent is a depressant selected from the group consisting of ligno sulfates, starch, gelatin, saponin, quebracho, sodium metaphospate, dextrin, aluminum hydroxide, iron hydroxide, lime, sodium silicate, and mixtures thereof.

94. The process of claim 92 wherein said first modifying agent is an activator selected from the group consisting of sulfuric acid, sodium hydroxide, calcium hydroxide, and mixtures thereof.

95. The process of claim 73 additionally comprising filming the surfaces of the second product prior to said treating step (h) with a second modifying agent in a second modifying conditioning zone at a ratio of between about 0.05 to about 10.0 lbs. of the second modifying agent per ton of the second-stage product.

96. The process of claim 95 wherein said second modifying agent is a depressant selected from the group consisting of ligno sulfates, starch, gelatin, saponin, quebracho, sodium metaphosphate, dextrin, aluminum hydroxide, iron hydroxide, lime, sodium silicate, and mixtures thereof.

97. The process of claim 95 wherein said second modifying agent is an activator selected from the group consisting of sulfuric acid, sodium hydroxide, calcium hydroxide, and mixtures thereof.

98. The process of claim 73 wherein said first collector is selected from the group consisting of tall oil, lignin, tallow, kerosene, shale oil fractionation products, methyl octaclecyl amino, lauryl amino hydrochloride, sodium oleate, oleic acid, linoleic acid, linolenic acid, and mixtures thereof.

99. The process of claim 73 wherein said second collector is selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof.

100. The process of claim 73 wherein said first frother is selected from the group consisting of methyl amyl alcohol, methylisobutylcarbinol, polypropylene glycol ether, pine oil, cresylic acid, terpinol, pentandiol, and mixtures thereof; and said first frother comprises between 0.01 to about 0.50% by weight of said first water suspension medium.

101. The process of claim 73 wherein said second frother is selected from the group consisting of methyl amyl alcohol, methylisobutylcarbinol, polypropylene glycol ether, pine oil, cresylic acid, terpinol, pentandiol, and mixtures thereof; and said second frother comprises between 0.01 to about 0.50% by weight of said second water suspension medium.

102. The process of claim 73 wherein said first and said second water suspension medium have a pH of between about 5 and 10; said aeration steps (e) and (j) are at a rate of between about 5 and 15 cubic feet per minute per square foot of the surface of the water suspension medium being aerated and are aerated from between about ½ minute to about 2 hours.

103. The process of claim 73 wherein said pumpable kerogen paste of step (l) is introduced at a temperature of between about 100 degrees Fahrenheit and 900 degrees Fahrenheit.

104. The process of claim 77 wherein said hydrogenation catalyst has a density of between about 0.6 to 5 gms/cc and an average size of between about 50 microns to about 450 microns.

105. The process of claim 79 wherein said hydrogenation catalyst has a density of between about 0.6 to 5 gms/cc and an average size of between about 50 microns to about 450 microns.

106. The process of claim 77 wherein said hydrogenation catalyst is selected from the group consisting of cobalt, iron, molybdenum, nickel, tungsten, platinum, palladium, their oxides, their sulfides, and mixtures thereof.

107. The process of claim 79 wherein said hydrogenation catalyst is selected from the group consisting of cobalt, iron, molydenum, nickel, tungsten, platinum, palladium, their oxides, their sulfides, and mixtures thereof.

108. A process for the production and conversions of shale kerogen to produce shale oil comprising in serial combination the steps of:

(a) grinding crushed shale at a temperature of between about 0 degrees centigrade to about 50 degrees centigrade into a first product consisting essentially of generally inert matter and generally liberated kerogen having an average fineness of between about 0.5 microns to about 250 microns;

(b) filming the surfaces of the first product at a temperature of between about 0 degrees centigrade to about 50 degrees centigrade and in a first modifying conditioning zone with a first modifying agent at a rate of between about 0.05 to about 10.0 lbs. of the first modifying agent per ton of the first product;

(c) treating in a first conditioning zone the surfaces of the first product of step (b) with a first collector selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof, at a rate of between about 0.005 to about 10.0 lbs. of the first collector per ton of the first product and at a temperature of between about 0 degrees centigrade to about 50 degrees centigrade in order to render the ground-liberated kerogen air-avid and water-repellent;

(d) introducing the ground-treated first product of step (c) into a first water suspension medium having a pH of between about 5 and 10 and between about 0.01 to about 0.50% by weight of a first frother selected from the group consisting of methyl amyl alcohol, methylisobutylcarbinol, polypropylene glycol ether, pine oil, cresylic acid, terpinol, pentandiol, and mixtures thereof, and a temperature of between about 0 degrees centigrade and 50 degrees centigrade;

(e) aerating at a rate of between about 5 and 15 cubic feet per minute per square foot of the surface of the first water suspension medium and from between ½ minute to about 2 hours, the first water suspension medium having the first frother in order to form a layer of foam on top of the first water suspension medium such that air-avid treated liberated kerogen having an average fineness of between about 5 microns to about 250 microns attaches to the rising bubbles of aeration where it collects in the foam;

(f) suspending simultaneously with said aerating step (e) the ground-treated first product in the first water suspension medium by a first means for agitation having a first impeller speed tip means and at an average pulp density of between about 10 to about 45% solids and at a rate of agitation of between about 5 and 2,000 ft./min. with an impeller speed tip means;

(g) skimming of the collected liberated kerogen from the surface of the first water suspension medium in order to recover liberated kerogen having an average fineness of between about 5 microns to 250 microns;

(h) grinding at a temperature of between about 0 degrees centigrade to about 50 degrees centigrade of the recovered liberated kerogen of step (g) into a second product consisting essentially of generally disassociated inert matter and generally clean kerogen having an average fineness of between about 0.5 microns to about 45 microns;

(i) filming the surfaces of the second product at a temperature of between about 0 degrees centigrade to about 50 degrees centigrade and in a second modifying conditioning zone with a second modifying agent at a rate of between about 0.05 to about 10.0 lbs. of the second modifying agent per ton of the second product;

(j) treating in a second conditioning zone the surfaces of the second product of step (i) with a second collector selected from the group consisting of tall oil, lignin, tallow, kerosene, shale oil fractionation products, methyl octadecyl amino, lauryl amino hydrochloride, sodium oleate, oleic acid, linoleic acid, linolenic acid, and mixtures thereof, at a rate of between about 0.005 to about 10.0 lbs. of the second collector per ton of the second product and at temperature of between about 0 degrees centigrade to about 50 degrees centigrade in order to render the ground-clean kerogen air-avid and water-repellent;

(k) introducing the ground-treated second product of step (j) into a second water suspension medium having a pH of between about 5 and 10 and between about 0.01 to about 0.50% by weight of a second frother selected from the group consisting of methyl amyl alcohol, methylisobutylcarbinol, polypropylene glycol ether, pine oil, cresylic acid, terpinol, pentandiol, and mixtures thereof, and a temperature of between about 0 degrees centigrade and 50 degrees centigrade;

(l) aerating at a rate of between about 5 and 15 cubic feet per minute per square foot of the surface of the second water suspension medium and from between ½ minute to about 2 hours the second water suspension medium in order to form a layer of foam on top of the second water suspension medium such that air-avid treated clean kerogen having an average fineness of between about 0.5 microns to about 45 microns attaches to the rising bubbles of aeration where it collects in the foam;

(m) suspending simultaneously with said aerating step (l) the ground-treated second product in the second water suspension medium by a second means for agitation having a second impeller speed tip means and at an average pulp density of between about 10 to about 45% solids and at a rate of agitation of between about 5 and 2,000 ft./min. with said second impeller speed tip means;

(n) skimming of the collected clean kerogen having at least 40% by weight of pure kerogen from the surface of the second water suspension medium in order to recover a clean kerogen product having an average fineness of between about 0.5 microns to 45 microns and containing at least 40% by weight of pure kerogen;

(o) mixing the recovered clean kerogen product of step (n) with a hydrocarbon liquid means to form a pumpable kerogen paste, and the liquid means in Bbls/ton of clean kerogen product ratio of pumpable kerogen paste feed varies from about 5:1 to about 50:1;

(p) introducing at a temperature of between about 100 degrees Fahrenheit and 900 degrees Fahrenheit the pumpable kerogen paste of step (o) into at least one upflow expanded catalytic bed reaction zone at a space velocity of between about 0.05 and about 4.0 tons of pumpable kerogen paste feed/hr./cu. ft. of reaction zone and wherein the reaction zone is maintained at a pressure of between about 50 and about 5,000 psi. and a temperature of between about 300 degrees Fahrenheit and about 1,000 degrees Fahrenheit and has a hydrogenation catalyst with a density of between about 0.6 to 5 gms/cc and an average size of between about 50 microns to about 450 microns;

(q) introducing a hydrogen containing gas into the reaction zone of step (p) in such a manner that the hydrogen containing gas flows upwardly at between about 2,000 to about 10,000 scf. per ton of pumpable kerogen paste feed in order to assist converting at least 50% by weight of the kerogen in the pumpable kerogen paste into a hydrocarbon liquid;

(r) removing the reaction mixture including the converted hydrocarbon liquid of step (q) from the reaction zone as total overhead effluent; and (s) separating the reactor effluent into two or more component streams.

* * * * *